US005813871A

United States Patent [19]

Grabbe et al.

[11] Patent Number: 5,813,871

[45] Date of Patent: Sep. 29, 1998

[54] HIGH FREQUENCY ELECTRICAL CONNECTOR

[75] Inventors: Dimitry Grabbe, Middletown; Iosif Korsunsky, Harrisburg, both of Pa.

[73] Assignee: The Whitaker Corporation, Wilmington, Del.

[21] Appl. No.: 690,130

[22] Filed: Jul. 31, 1996

[51] Int. Cl.[6] ..... H01R 4/66

[52] U.S. Cl. ..... 439/108; 439/608

[58] Field of Search ..... 439/108, 74, 607, 439/947, 101, 544, 608, 941

[56] References Cited

U.S. PATENT DOCUMENTS

| | | | |
|---|---|---|---|
| 4,571,014 | 2/1986 | Robin et al. | 339/14 R |
| 4,611,867 | 9/1986 | Ichimura et al. | 339/14 R |
| 4,616,893 | 10/1986 | Feldman | 339/14 R |
| 4,762,500 | 8/1988 | Dola et al. | 439/79 |
| 4,824,383 | 4/1989 | Lemke | 439/108 |
| 5,066,236 | 11/1991 | Broeksteeg | 439/108 |
| 5,127,839 | 7/1992 | Korsunsky et al. | 439/108 |
| 5,160,273 | 11/1992 | Carney | 439/608 |
| 5,183,405 | 2/1993 | Elicker et al. | 439/108 |
| 5,195,899 | 3/1993 | Yatsu et al. | 439/108 |
| 5,197,893 | 3/1993 | Morlion et al. | 439/101 |
| 5,201,855 | 4/1993 | Ikola | 439/607 |
| 5,238,414 | 8/1993 | Yaegashi et al. | 439/608 |
| 5,254,010 | 10/1993 | Davis | 439/108 |
| 5,304,069 | 4/1994 | Brunker et al. | 439/108 |
| 5,429,520 | 7/1995 | Morlion et al. | 439/108 |
| 5,433,618 | 7/1995 | Morlion et al. | 439/108 |
| 5,496,180 | 3/1996 | Fabian et al. | 439/60 |
| 5,600,544 | 2/1997 | Thalhammer | 361/816 |

FOREIGN PATENT DOCUMENTS

| | | | |
|---|---|---|---|
| 0670615A1 | 9/1995 | Germany | H01R 23/68 |
| WO 95/33290 | 12/1995 | WIPO | H01R 23/68 |

*Primary Examiner*—Neil Abrams
*Assistant Examiner*—Tho D. Ta
*Attorney, Agent, or Firm*—James M. Trygg; Salvatore Anastasi

[57] ABSTRACT

A connector (10) for interconnecting circuitry (12, 16) of two circuit boards (14, 18) which carry relatively high frequency signals, includes a receptacle connector (20) and a mating plug connector (24). The receptacle connector (20) includes shield plates (56) between each adjacent pair of signal contacts (58) and the mating plug connector (24) includes a central elongated ground plate (136) that electrically engages each of the shield plates (56). The ground plate (136) includes a plurality of leads (142) along its length that engage ground pads on the circuit board (18). The plug connector (24) includes an outer shield (146) that substantially surrounds the plug connector (24) and includes leads (148) that are attached to the leads (142) of the elongated ground plate (136).

32 Claims, 10 Drawing Sheets

HIGH FREQUENCY ELECTRICAL CONNECTOR

The present invention relates to electrical connectors for carrying high speed signals in the interconnection of electrical circuits on circuit boards and more particularly to such connectors having improved ground shielding.

BACKGROUND OF THE INVENTION

Electrical connectors for interconnecting circuitry on two circuit boards, typically in the computer and related industries, must be easily mountable to either the edge or surface of the circuit board, in many cases utilizing surface mount technology. Such connectors usually contain a relatively large number of pins for interconnecting signals and a fewer number of pins for interconnecting to ground. A typical prior art connector of this type, for example, is disclosed in U.S. Pat. No. 4,762,500 which issued Aug. 9, 1988 to Dola et al. This connector includes an insulating housing having two rows of closely spaced signal contacts and a central ground plate that extend between the two rows of signal contacts. The connector is impedance matched as closely as its structure allows, however, it is limited to interconnecting signals having rise times of much less than 200 picoseconds. Further, this connector is relatively large having only 32 pins for signal interconnections. As the industry requires connectors having larger numbers of pins, due largely to increases in computer word length from 32 bits to 64 bits, to 128 bits and higher, necessarily these pins must be packed more closely together to remain within an acceptable overall package size. The electrical characteristics of the connector become more important as the connector is miniaturized to meet the current trend of the industry and as the speed of the signals that are being interconnected increase. Such an increase in speed results in various well known problems such as crosstalk between signal contacts, transmission losses, reflections and ground bounce or switching noise. Coaxial connectors and coaxial multicore connectors are able to interconnect these high speed signals while avoiding the above mentioned problems, however, such coaxial structures are difficult to miniaturize. See, for example, U.S. Pat. No. 4,611,867 which issued Sep. 16, 1986 to Ichimura et al., which discloses a matrix of two interconnecting sets of spaced plates arranged to form boxes, a signal contact being disposed within each box. Such a structure can be miniaturized only to modest limits. Further, when large numbers of signal contacts are required, the present state of the art requires that several individual connectors be individually mounted to the circuit board. Due to dimensional tolerances of the components, there must necessarily be clearance space around each connector, thereby wasting scarce circuit board space.

What is needed is a compact connector having a relatively large number of signal contacts that provide high electromagnetic integrity and are sufficiently isolated from one another to interconnect relatively high speed signals, in the 50 picosecond range. Further, in the case where large numbers of signal contacts are required, the connector should be easily combined with one or more similar connectors to form a module that can be mounted as a single unit to a circuit board.

SUMMARY OF THE INVENTION

An electrical connector is disclosed for interconnecting first and second electrical circuits on first and second circuit boards, respectively, wherein the electrical circuits have both ground pads and signal pads. The connector includes an electrically insulating elongated housing having a length and first and second matable housing parts with first and second longitudinal axes, respectively. The first housing part has first, second, and third openings therein extending parallel to the first axis for a major portion of the length. The first and third openings have contact receiving walls on opposite sides of and adjacent the second opening. A plurality of electrical contacts are arranged in the housing, each contact including first and second matable contacts with a lead extending from each contact. All of the first contacts are in the first housing part and the leads thereof are adapted for electrical engagement with the first circuit. Similarly, all of the second contacts are in the second housing part and the leads thereof are adapted for electrical engagement with the second circuit. Some of the first contacts are spaced along the contact receiving wall of the first opening and others of the first contacts are spaced along the contact receiving wall of the third opening. An elongated ground plate is disposed in the second housing and extends into the second opening of the first housing. A plurality of electrically conductive shield plates are disposed in the first housing in electrical engagement with the elongated ground plate. A shield plate is disposed between each adjacent pair of first contacts.

DESCRIPTION OF THE PREFERRED EMBODIMENT

Figure 1:
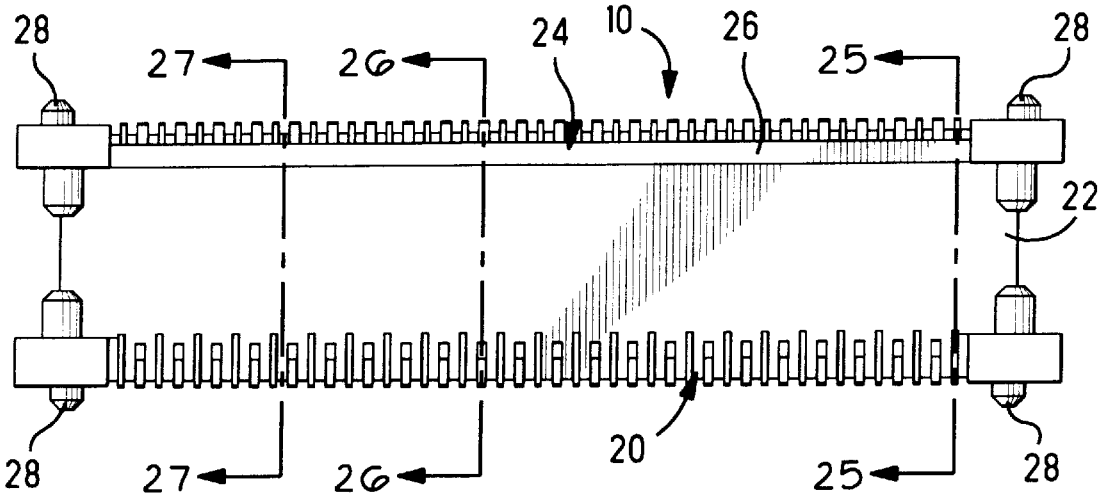
FIGS. 1 and 2 are front and end views, respectively, of an electrical connector incorporating the teachings of the present invention.
Figure 2:
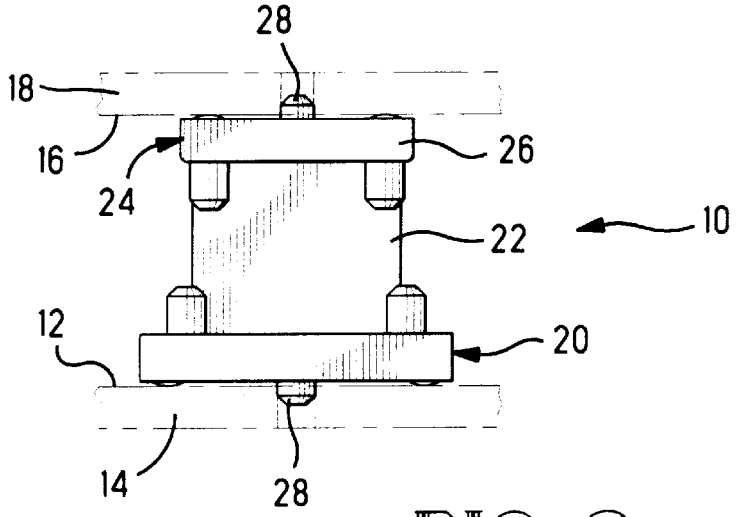

There is shown in FIGS. 1 and 2 an electrical connector 10 interconnecting first circuitry 12 on a first circuit board 14 to second circuitry 16 on a second circuit board 18, the first and second circuit boards being shown in phantom lines. The connector 10 includes a receptacle connector 20 having a first housing part 22 and plug connector 24 having a second housing part 26 in mating engagement with the first housing part. Each of the first and second housing parts 22 and 26 has two spaced apart pins 28 that extend into holes in a respective circuit board 14, 18 for accurately positioning the two connector halves with respect to the first and second circuits 12 and 16.

Figure 3:
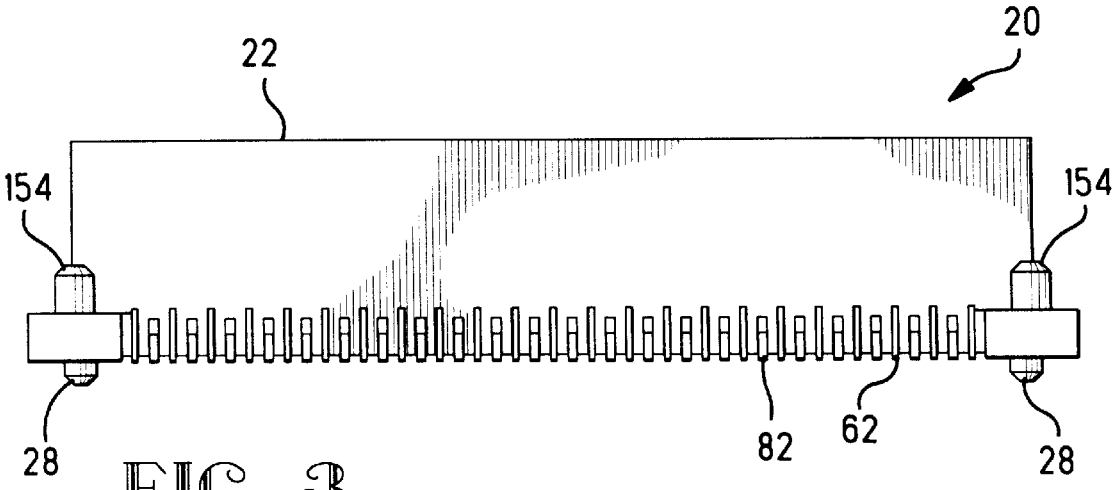
FIGS. 3, 4, and 5 are front, plan, and end views, respectively of the receptacle connector shown in FIG. 1.
Figure 4:
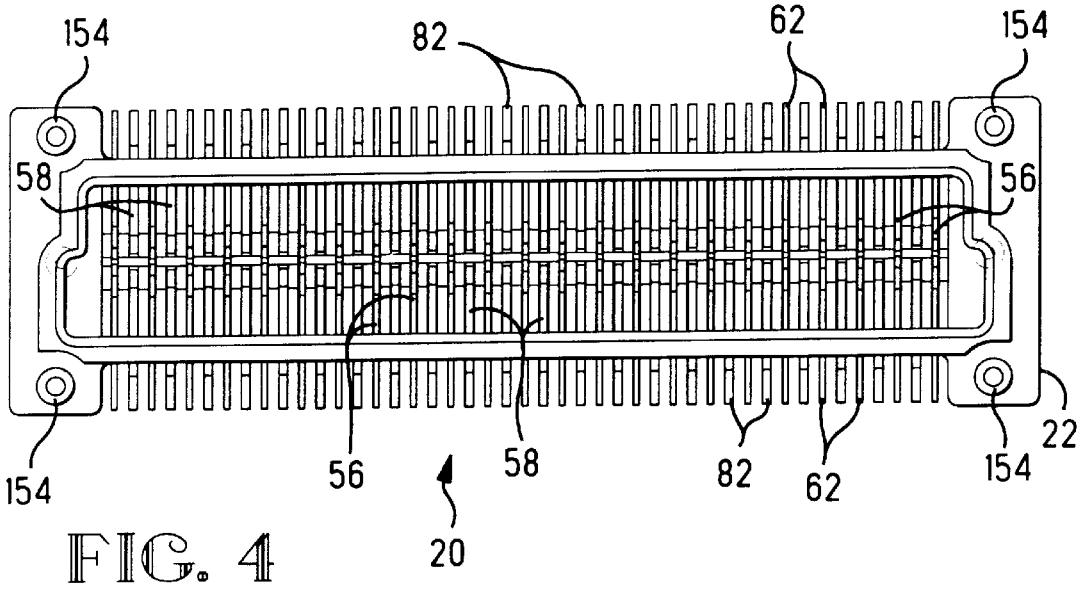
Figure 5:
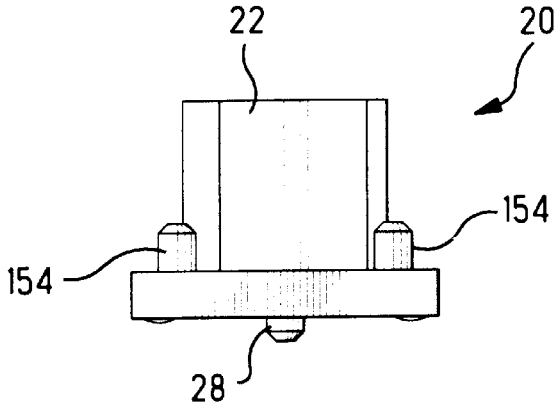
Figure 9:
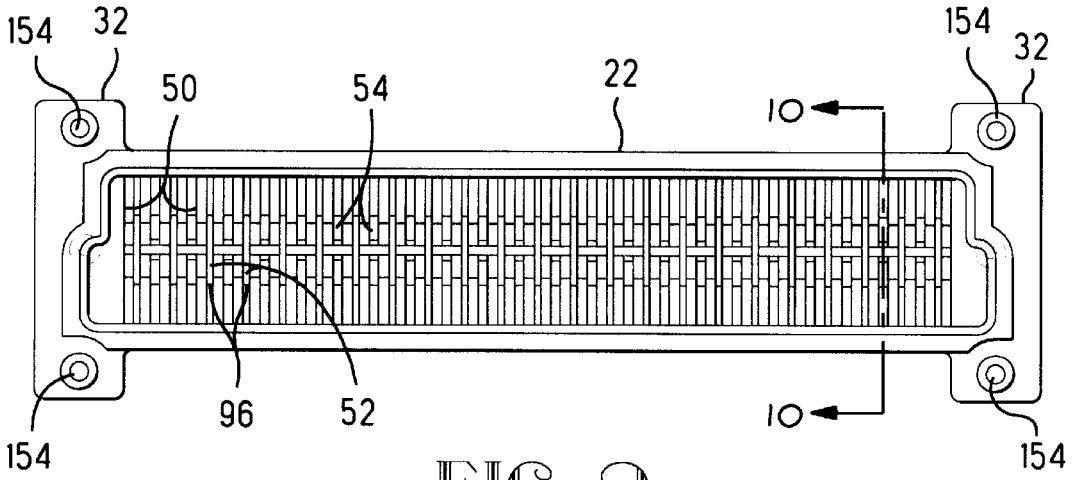
FIG. 9 is a plan view of the housing of the receptacle connector shown in FIG. 4.
Figure 10:
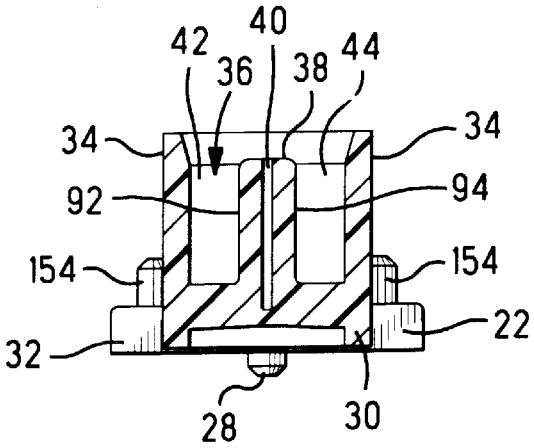
FIG. 10 is a cross-sectional view taken along the lines 10—10 in FIG. 9.
Figure 27:
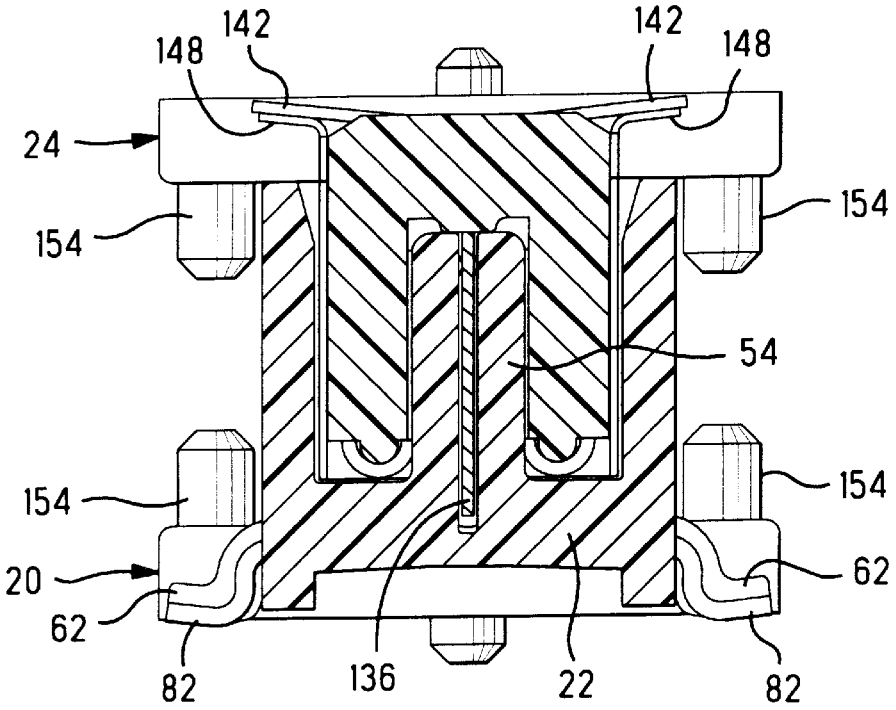

The receptacle connector 20 is shown in FIGS. 3, 4, and 5 and the first housing part 22 is shown in FIGS. 9 and 10. The first housing part 22 includes a base 30 and two flanges 32 arranged at opposite ends of the base. A shroud 34 extends from the base 30, as best seen in FIGS. 9 and 10, to form a cavity 36 for receiving a mating portion of the plug connector 24, as will be explained below. The base 30 includes a central portion 38 that extends well into the cavity 36, the central portion having a slot 40 running the entire length of the central portion. The central portion 38 thereby forms three elongated openings, a first elongated opening 42, the slot 40 or second elongated opening, and a third elongated opening 44, all of which are within the cavity 36, as best seen in FIG. 10. As shown in FIG. 9, a plurality of relatively thin openings 50 are formed through the base 30 and spaced along its length within the cavity 36. A plurality of additional openings 52 are formed through the base 30 and arranged so that one opening 52 is between each adjacent pair of openings 50. A rib 54 of the central portion 38 remains between each adjacent pair of openings 50 and 52, as best seen in FIGS. 9 and 27.

Figure 19:
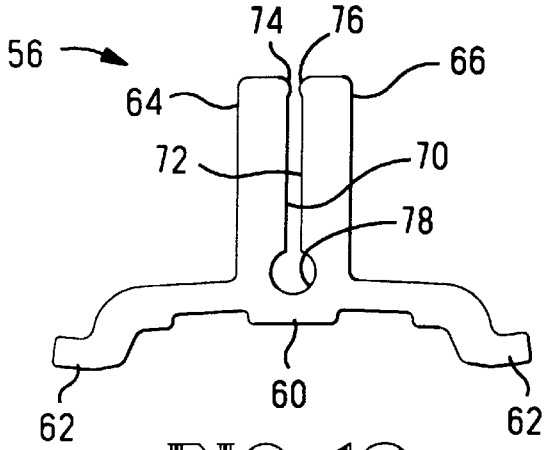
FIGS. 19 and 20 are side and end views, respectively, of a shield plate of the receptacle connector shown in FIG. 4.
Figure 20:
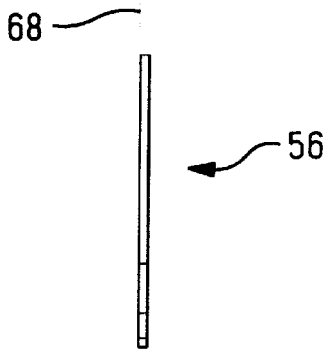
Figure 21:
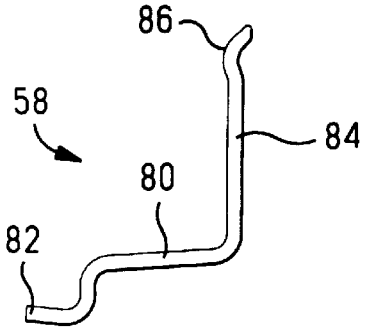
FIGS. 21 and 22 are side and end views, respectively, of a signal contact of the receptacle connector shown in FIG. 4.
Figure 22:
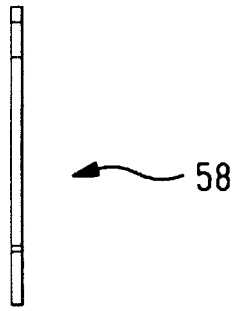
Figure 25:
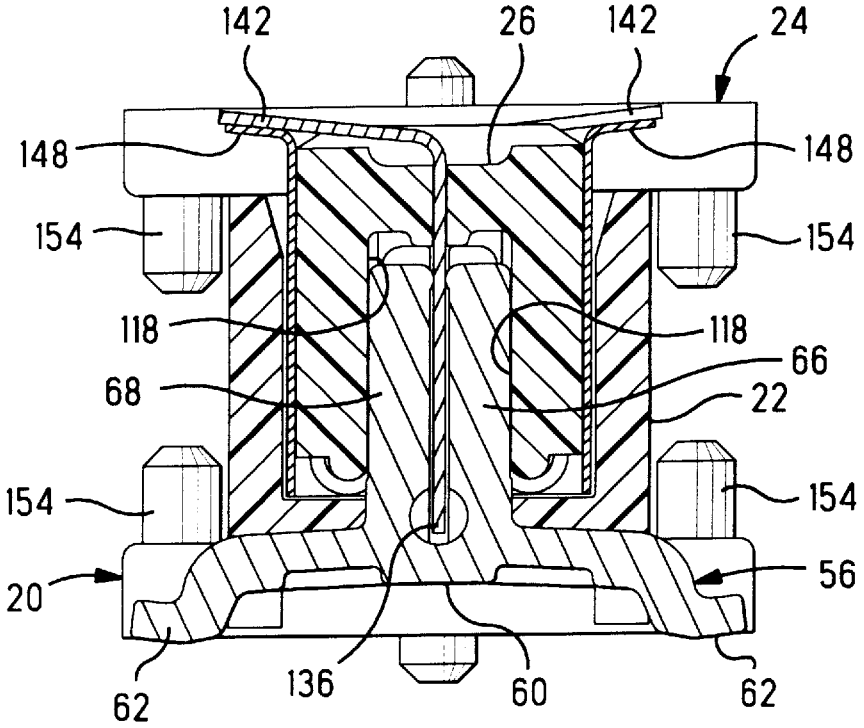
FIGS. 25, 26, and 27 are cross-sectional views taken along the lines 25—25, 26—26, and 27—27, respectively, in FIG. 1.
Figure 26:
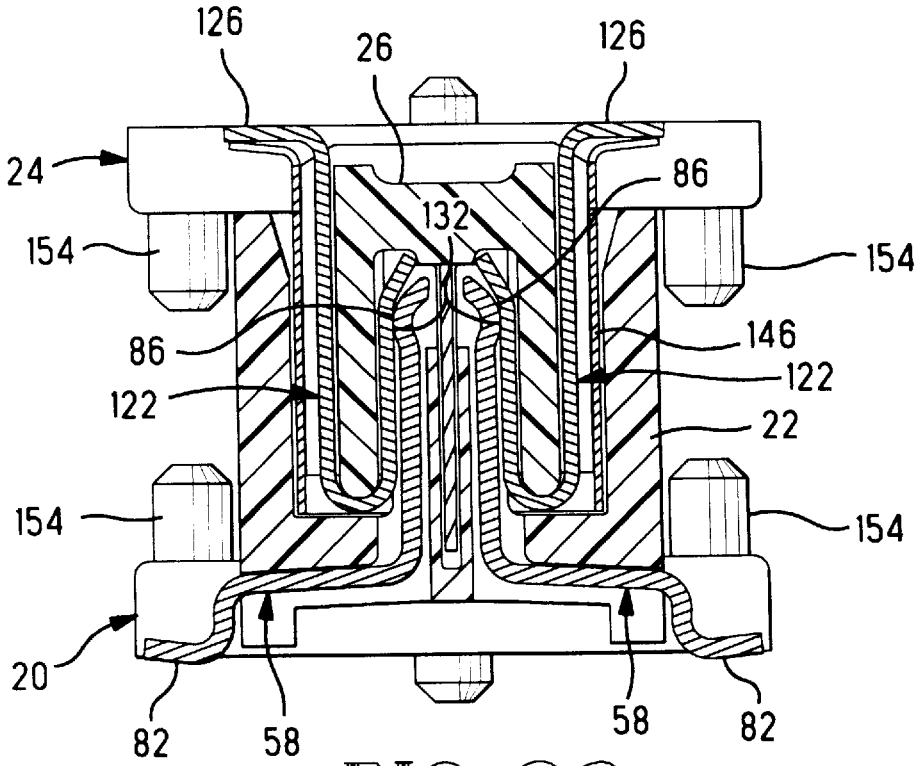

As shown in FIG. 4, a plurality of shield plates 56 are arranged in the openings 50 of the base 30 and a plurality of first signal contacts 58 are arranged in the openings 52 of the base. Each of the shield plates 56, as best seen in FIGS. 19 and 20, is a flat stamping and includes a base 60, a lead 62 extending from each end of the base for contacting ground pads on the first circuit 12, and two shield portions 64 and 66 that extend cantilevered from the base in a direction opposite that of the leads 62. The base 60, two leads 62, and the two shield portions 64 and 66 define and lie in a common plane 68. The two shield portions 64 and 66 have opposing spaced edges 70 and 72, respectively, the edges having contacting surfaces 74 and 76, respectively. The contacting surfaces, in the present example, are arcuate. The edges 70 and 72 terminate in an opening 78 at the base 60 thereby allowing the two shield portions 64 and 66 to deflect within the plane 68 within their elastic limits and return to their original positions shown in FIG. 19, for a purpose that will be explained. The two shield portions 64 and 66 extend upwardly between the ribs 54, as shown in FIGS. 4 and 25, so that a shield portion is between every two adjacent first signal contacts 58 and extends into either a first opening 42 or a third opening 44. As shown in FIGS. 21 and 22, the first signal contacts 58 include a base 80, a lead 82 for contacting a signal pad or point of the first circuit 12, and a beam member 84 extending upwardly from the base in a direction opposite that of the lead. The beam member 84 terminates in an arcuate contact surface 86. The first signal contacts 58 are arranged within the openings 52 in opposing pairs, as shown in FIGS. 4 and 26. That is, every contact 58 is opposite to another contact 58. The beam 84 of one of the contacts is in the first elongated opening 42 and closely adjacent a contact receiving wall 92, shown in FIG. 10, and the beam 84 of the other contact is in the second elongated opening 44 and closely adjacent a contact receiving wall 94. The contact receiving walls 92 and 94 include slight recesses 96 that receive and guide the beams 84 of the contacts.

Figure 6:
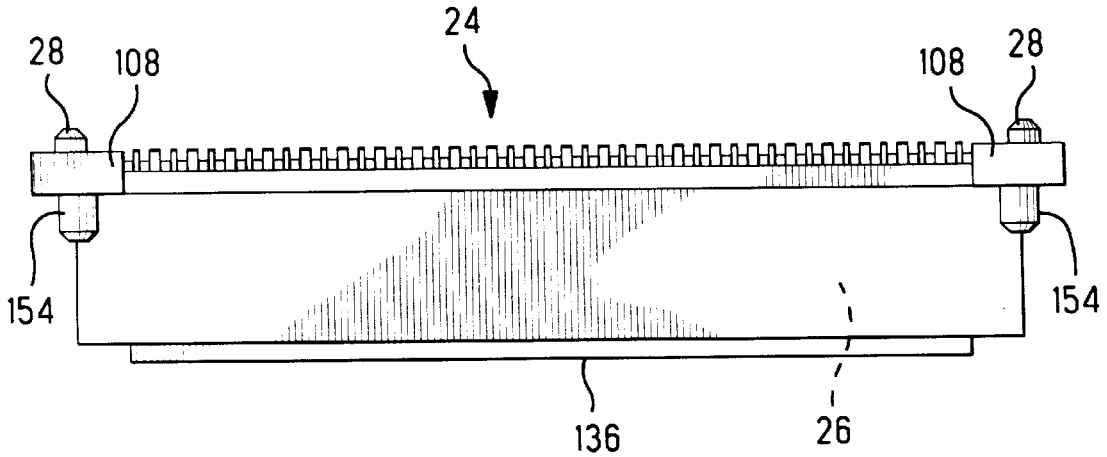
FIGS. 6, 7, and 8 are front, plan, and end views, respectively of the plug connector shown in FIG. 1.
Figure 7:
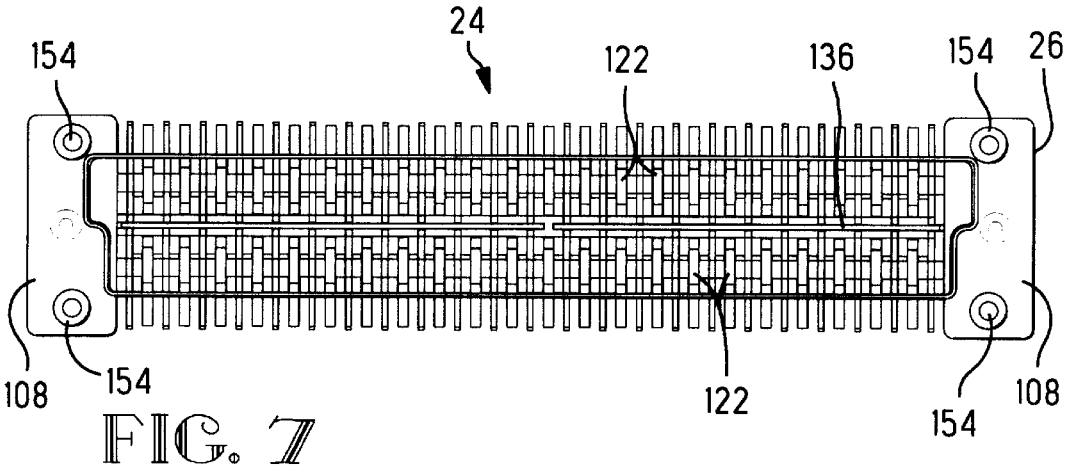
Figure 8:
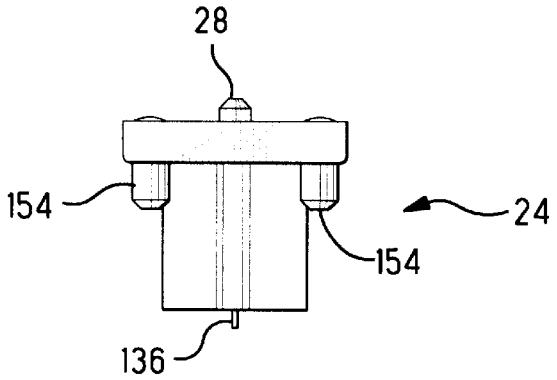
Figure 11:
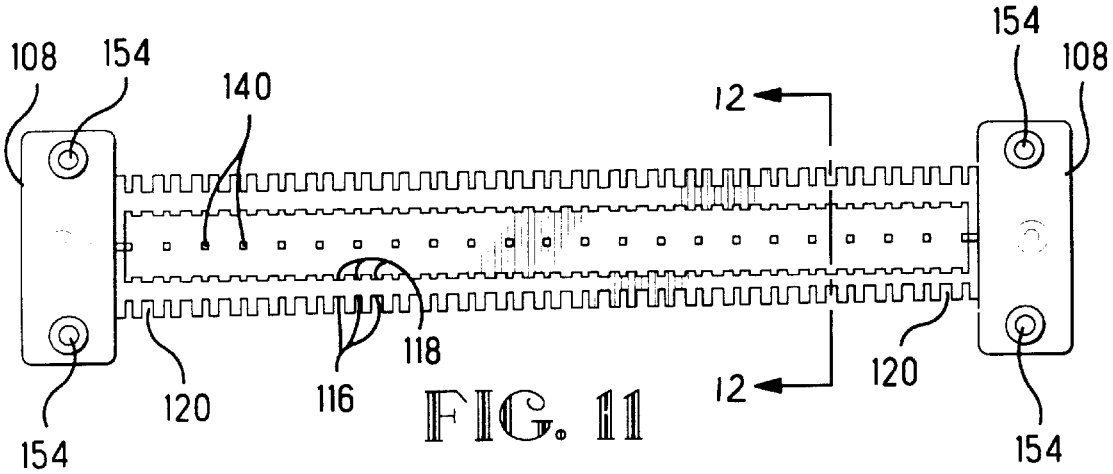
FIG. 11 is a plan view of the housing of the plug connector shown in FIG. 7.
Figure 12:
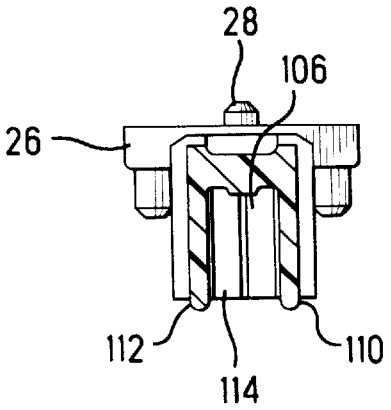
FIG. 12 is a cross-sectional view taken along the lines 12—12 of FIG. 11.
Figure 13:
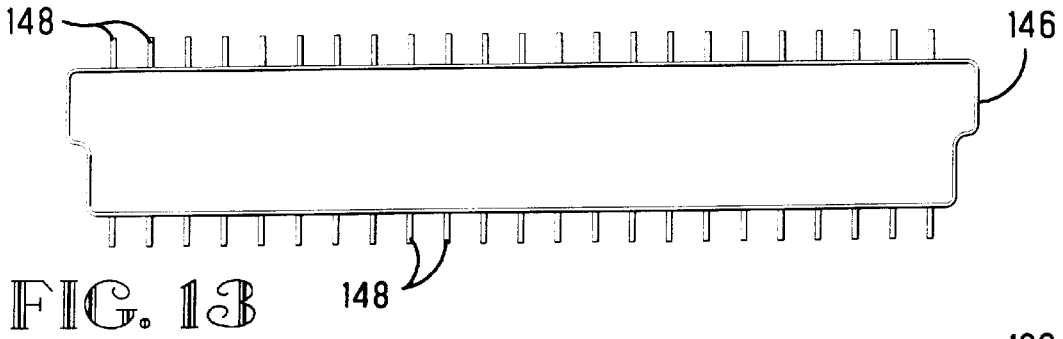
FIGS. 13 and 14 are plan and end views, respectively, of the outer shield of the plug connector shown in FIG. 7.
Figure 14:
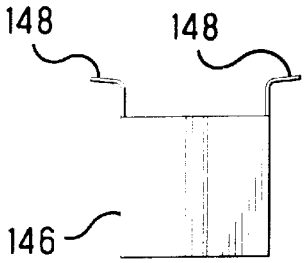
Figure 23:
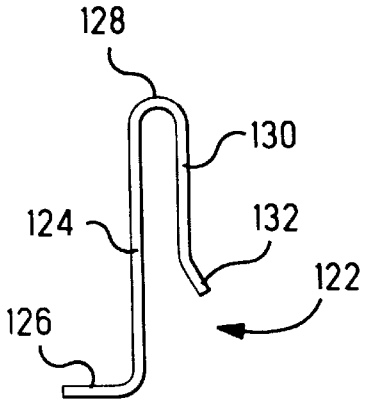
FIGS. 23 and 24 are side and end views, respectively, of a signal contact of the plug connector shown in FIG. 7.
Figure 24:
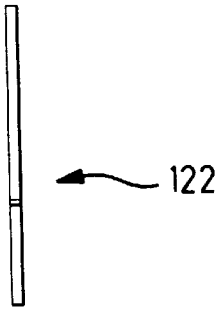

The plug connector 24 is shown in FIGS. 6, 7, and 8 and the second housing part 26 is shown in FIGS. 11 and 12. The second housing part 26 includes a base 106 and two flanges 108 arranged at opposite ends of the base. A pair of spaced apart contact receiving walls 110 and 112 extend upwardly from the base 106, as best seen in FIG. 12, thereby forming an interior 114 that will receive the central portion 38 of the receptacle connector 20 with clearance. A series of outer and inner recesses 116 and 118, respectively, are formed in each of the two contact receiving walls 110 and 112, as shown in FIG. 11. As best seen in FIG. 7, a plurality of second signal contacts 122 is arranged in every other of the recesses 116 and 118 beginning with the second recess, indicated at 120 in FIG. 11, from each flanges 108. The other recesses 116 and 118 remain empty until the plug connector 24 is mated with the receptacle connector 20, at which time the shield portions 64 and 66 of the shield plates 56 enter into these other inner recesses 118 between the second signal contacts 122, as can be seen in FIG. 25. Each of the second signal contacts 122, as best seen in FIGS. 23 and 24, include a shank 124, a lead 126 extending from one end of the shank at a bight 128, and a beam 130 extending from the other end of the shank in a direction opposite to that of the lead. The beam 130 includes a contact surface 132 for engagement with the contact surface 86 of the first contact 58. The recesses 116 and 118 are spaced so that the second signal contacts 122 are exactly opposed to the first signal contacts 58 when the plug connector 24 is mated with the receptacle connector 20, each contact 122 mating with a respective contact 58. There is sufficient clearance in the inner recesses 118 and the recesses 96 to permit elastic deflection of the two beams 130 and 84 during mating.

Figure 16:
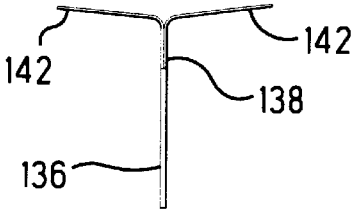
FIGS. 15 and 16 are plan and end views, respectively, of the central ground plate of the plug connector shown in FIG. 7.
Figure 18:
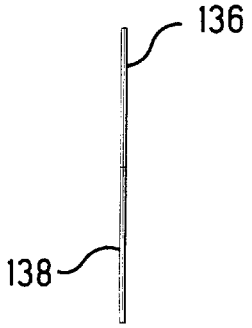
FIGS. 17 and 18 are front and end views, respectively, of the central ground plate prior to forming the leads, as shown in FIG. 16.
Figure 15:
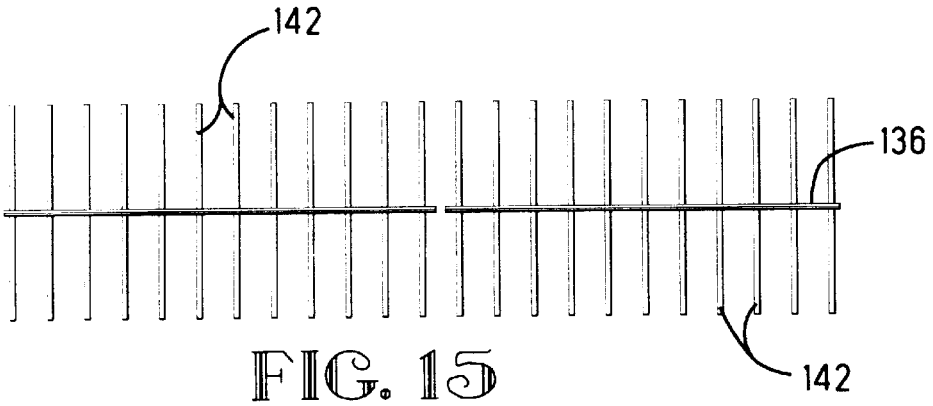
Figure 17:
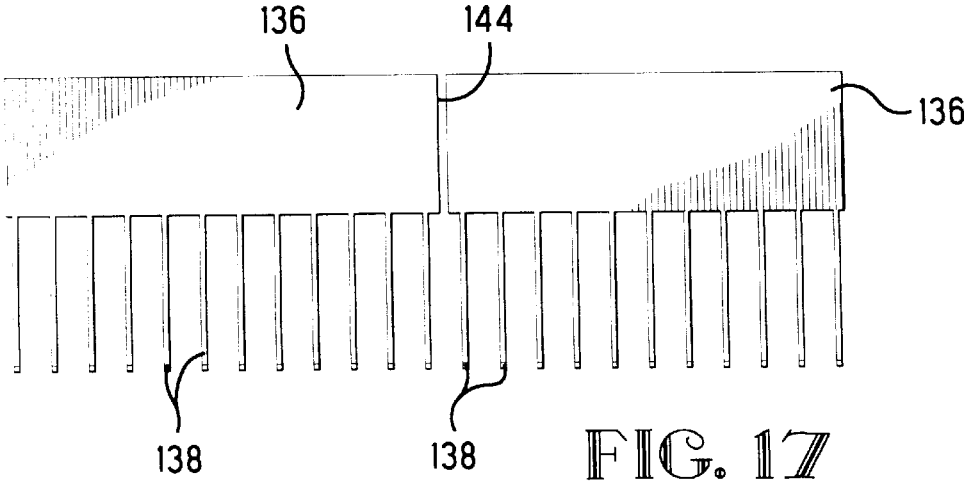

The plug connector 24 includes an electrically conductive central ground plate 136, as shown in FIGS. 6, 7, and 8. The ground plate 136 includes a plurality of tails 138 extending from one edge thereof, as shown in FIGS. 17 and 18. The tails 138 extend through holes 140 formed through the base 106 of the second housing part 26, as best seen in FIG. 11. Once the tails 138 are in place within the holes 140 the ends of the tails 140 are bent outwardly to form leads 142, as shown in FIGS. 15 and 16. The tails 140 are alternately bent outwardly, first in one direction and then in the other direction so that there is an equal number of leads 142 on each side of the ground plate 136, as shown in FIG. 15. Optionally, the ground plate 136 may be split at 144 to form two electrically separate plates 136, as shown in FIG. 17. This allows the option of having the two plates 136 perform different functions such as providing power through one and ground through the other. Additionally, the plug connector 24 includes an electrically conductive outer shield 146 that substantially surrounds the plug connector 24 on four sides, except for the two flanges 108 and the leads 126 and 142, as best seen in FIGS. 6, 7, and 8. The periphery of the outer shield 146 is shaped and sized to fit within the cavity 36 with clearance when the plug connector 24 is mated with the receptacle connector 20. A plurality of leads 148 extend from a bottom edge of the outer shield 146 and are spaced so that each lead 148 is in alignment with and in contact with the upper surface of a respective lead 142 of the central ground plate 136. Each lead 148 is electrically and mechanically connected to its respective lead 142, for example by welding, soldering, or other means, to form closely spaced ground paths. In the alternative case mentioned above where the elongated ground plate 136 is split in two pieces, then the tails 138 will not be bent into leads 142, but rather will extend straight through the connector and into engagement with appropriate pads of the second circuit 16 that are disposed under the plug connector 24. The walls of the outer shield 146 are spaced from the shanks 124 of the second signal contacts 122 a distance that is less than the distance between adjacent second signal contacts. This substantially reduces crosstalk between adjacent second signal contacts and prevents radiation either into or out of the connector thereby enhancing the signal integrity of the connector.

Figure 28:
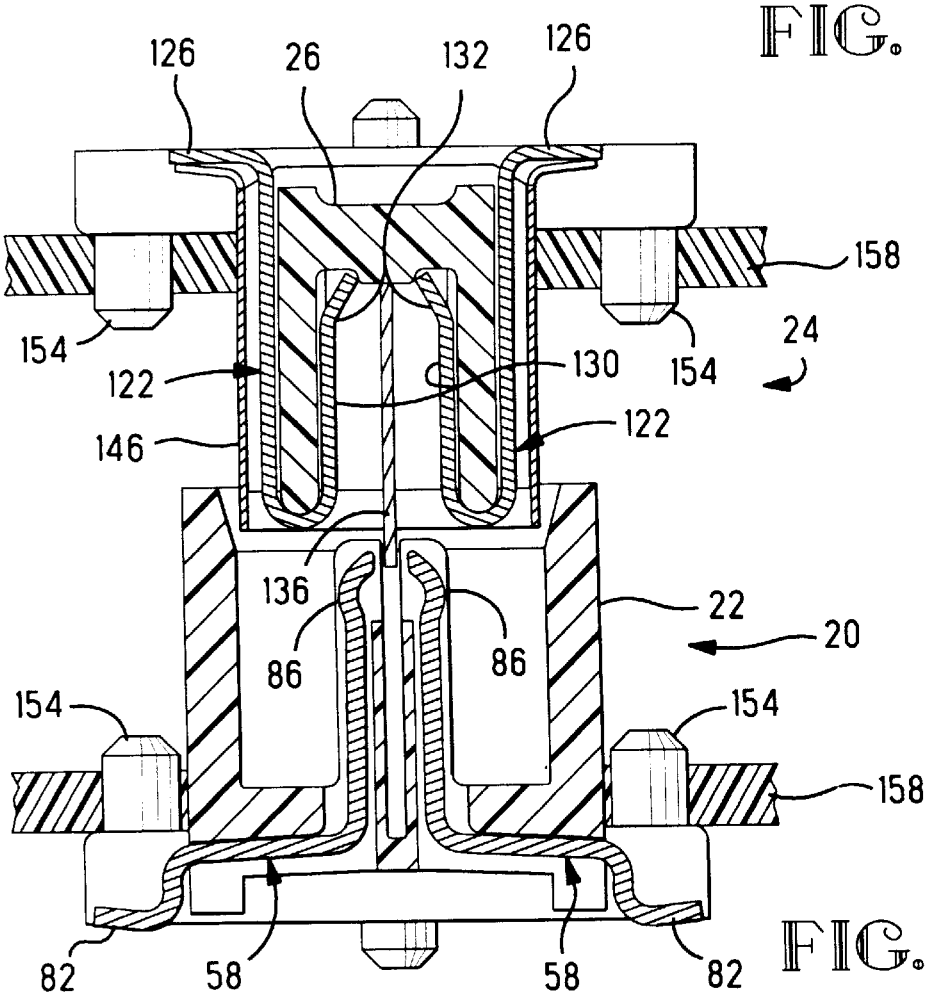
FIG. 28 is a view similar to that of FIG. 26 showing the plug and receptacle connectors separated.

When the plug connector 24 is being mated with the receptacle connector 20, as shown in FIG. 28, the elongated ground plate 136 enters the slot 40, engages the contacting surfaces 74 and 76 of the shield plates 56 thereby slightly deflecting the shield portions 64 and 66 apart as the ground plate 136 fully enters the slot 40. Concurrently, the portion of the surface of the beam 130 adjacent the bight 128 contacts the contact surfaces 86 of the first signal contacts 58, the contacting surfaces 86 sliding along the surfaces of the two beams 130 until they engage the contact surfaces 132, at which point the plug and receptacle connectors are fully seated. Note that the two beams 84 and 130 are slightly deflected thereby providing the necessary stored energy and resulting force to the points of contact to effect a good electrical connection. When the plug and receptacle connectors are fully mated, as shown in FIGS. 25, 26, and 27, the elongated ground plate 136 is well into the slot 40 and in electrical engagement with the contact surfaces 74 and 76 of each of the shield plates 56. This provides a relatively short ground path from a ground pad on the first circuit 12 to a ground pad on the second circuit 16 adjacent every first and second contact 58 and 122, thereby greatly reducing crosstalk between the two adjacent signal contacts. The combination of the short ground paths between the signal contacts provided by the central ground plate and the shield plates, and the outer shield provides a connector capable of interconnecting high speed signals having rise times of about 50 picoseconds. Each of the mated first and second contacts 58 and 122 are substantially surrounded by ground members thereby creating a near coaxial environment having the benefits of coaxial construction without the detriments of bulky structures.

Figure 31:
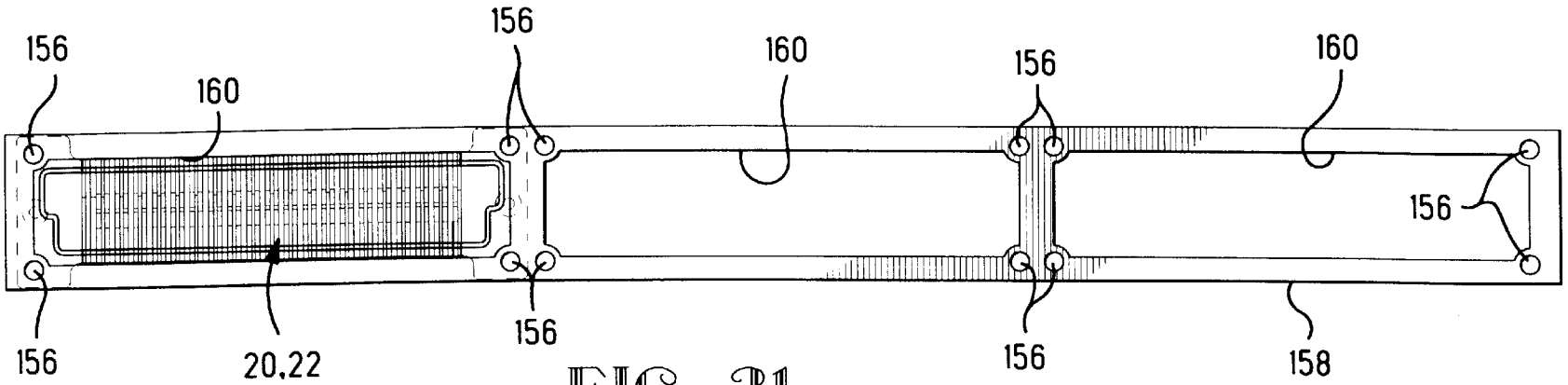
FIG. 31 is a plan view of a template for aligning and holding multiple connectors.

As shown in FIGS. 3, 5, 6, and 8, the receptacle and plug connectors 20 and 24 both include locating features, such as pins 154 in the present example, that engage accurately positioned holes 156 formed in a template 158, shown in FIG. 31. The template 158 includes three openings 160 for receiving either three receptacle connectors 20 or three plug connectors 24. When it is desired to mount several receptacle or plug connectors together, the connectors are inserted into adjacent openings 160 The several connectors are inserted into the openings 160 and their pins 154 inserted into the locating holes 156. This provides a compact module of several connectors that can be handled as a single unit when mounting to a circuit board. Such an arrangement permits the mounting of these several connectors without the need for clearance space therebetween to accommodate tolerances, thereby saving board space. It will be appreciated by those skilled in the art that locating means other than the pins 154 and holes 156 may be advantageously utilized in the practice of the present invention. Such other means could include projections and mating notches or openings on the connectors and the template 158. The important requirement is that the locating means accurately position and hold the several connectors so that their leads will properly engage the pads of the circuit boards when assembled thereto and act as a single long connector properly located so as to be able to mate with the opposite set of connectors. Similarly, a template having two or four or more openings 160 may be provided and will function in a manner similar to the template 158. In situations where multiple rows of connectors are utilized a single template having multiple rows of openings 160 can be utilized to properly position the leads of the connectors to their respective pads on the circuit board.

Figure 29:
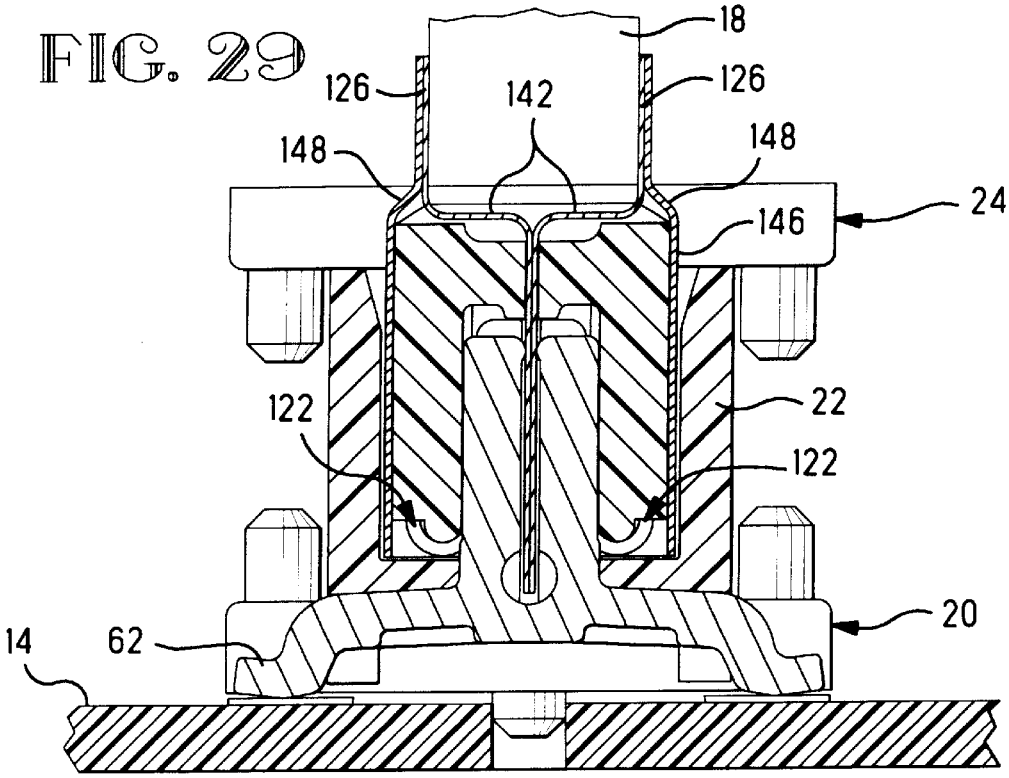
FIGS. 29 and 30 are cross-sectional views similar to that of FIG. 26 showing different embodiments of the plug connector.
Figure 30:
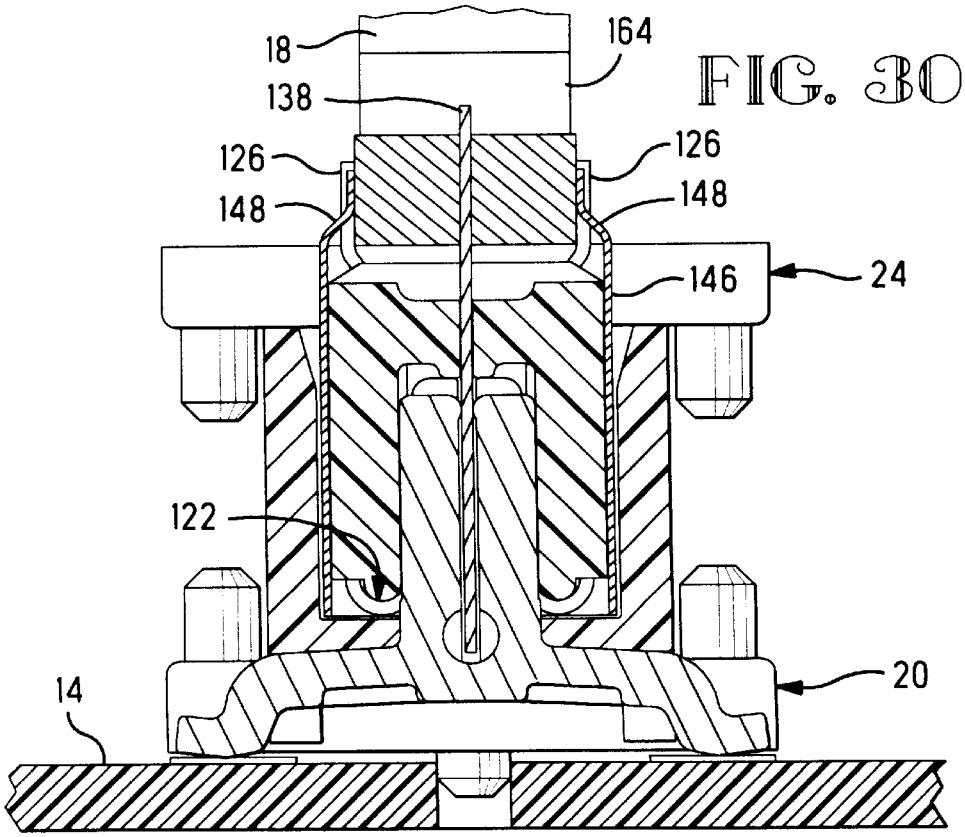

While the receptacle and plug connectors 20 and 24 have been described in terms of mounting to a major surface of a circuit board, they also may be configured to mount to an edge of a circuit board. Such a configuration for the plug connector 24 is shown in FIGS. 29 and 30. As shown in FIG. 29 the plug connector 24 is mounted to the edge of the second circuit board. In this configuration the leads 126 of the second signal contacts 122 are formed parallel to their shanks 124 so that they engage the signal pads of the second circuit 16 on the second circuit board 18 as shown. In a manner similar to that of the configuration shown in FIG. 28, the leads 142 of the elongated ground plate 136 are in engagement with the ground pads of the second circuit 16 and each of the leads 148 of the outer shield 146 is in engagement with an outer surface of a respective lead 142. As stated above, this arrangement requires less surface area on the circuit board to make the necessary ground connections since each lead 148 is paired to a lead 142 on a single ground pad. FIG. 30 illustrates a variation of the configuration shown in FIG. 29. As shown in FIG. 30 the elongated ground plate 136 is arranged with its tails 138 extend through the edge of the circuit board and into a plated through hole 164 for interconnection to the second circuit 16. In this configuration the elongated ground plate 136 may, optionally, be split as described above. The leads 126 of the second signal contacts 122 are formed to engage pads of the second circuit 16 on the two opposite major surfaces of the circuit board as shown rather than being bent outwardly at right angles thereto as shown in FIG. 28. The leads 148 of the outer shield 146 are similarly formed to engage ground pads of the second circuit 16.

An important advantage of the present invention is that a compact connector is provided having a relatively large number of signal contacts with improved ground shielding that provides high electromagnetic integrity and where the signal contacts are sufficiently isolated from one another to interconnect relatively high speed signals, in the 50 picosecond range, without adverse effects. Further, in the case where large numbers of signal contacts are required, the connector is easily combined with one or more similar connectors to form a module that can be mounted as a single unit to a circuit board.

We claim:

1. An electrical connector for interconnecting first and second electrical circuits on first and second circuit boards, respectively, said electrical circuits having both ground pads and signal pads, comprising:

(a) an electrically insulating elongated housing having a length and first and second matable housing parts with first and second longitudinal axes, respectively, said first housing part having first, second, and third openings therein extending parallel to said first axis for a major portion of said length, said first and third openings having contact receiving walls on opposite sides of and adjacent said second opening;

(b) a plurality of electrical contact pairs in said housing, each contact pair including first and second matable contacts having a lead extending from each said contact, each of said first contacts being in said first housing part and said lead thereof adapted for electrical engagement with said first circuit, and each of said second contacts being in said second housing part and said lead thereof adapted for electrical engagement with said second circuit, some of said first contacts being spaced along said contact receiving wall of said first opening and others of said first contacts being spaced along said contact receiving wall of said third opening;

(c) an elongated electrically conductive ground plate disposed between rows of said second contacts in said second housing and extending into said second opening of said first housing; and (d) a plurality of electrically conductive shield plates disposed in said first housing in electrical engagement with said elongated ground plate, said shield plate being disposed between each adjacent pair of said first contacts.

2. The connector according to claim 1 wherein a said shield plate is disposed between each adjacent pair of first contacts in said first opening and between each adjacent pair of first contacts in said third opening and wherein portions of each said shield plate extend into both said first opening and said third opening.

3. The connector according to claim 1 wherein said elongated ground plate has a plurality of leads spaced along its length interconnected to respective said ground pads of said second circuit and wherein each said shield plate has a lead adapted for electrical engagement with a respective said ground pad of said first circuit, said elongated ground plate in electrical engagement with each said shield plate to provide a relatively short ground path between said first and second circuits adjacent each of said electrical contacts.

4. The connector according to claim 3 wherein each of said shield plates is a flat stamping having a base and two shield portions extending, in a plane, cantilevered from said base with opposing spaced edges, each of said opposing edges having a contacting surface thereon for effecting said electrical engagement with said elongated ground plate.

5. The connector according to claim 4 wherein said second housing part has a pair of opposed contact receiving walls, each of which has a plurality of spaced inner recesses, each said shield portion extending into a respective one of said inner recesses, and wherein one of said shield portions is between said some of said first contacts in said first opening and the other of said shield portions is between said others of said first contacts in said third opening, and wherein said contacting surfaces of each of said shield plates are in said second opening of said first housing part.

6. The connector according to claim 4 wherein said two shield portions of each said shield plate are resilient beams spaced apart so that their respective contacting surfaces deflect away from each other as said elongated ground plate is inserted therebetween to effect said electrical engagement.

7. The connector according to claim 6 wherein said lead of each said shield plate comprises two lead portions extending from opposite sides of said base in a direction opposite that of said two shield portions, each said lead portion adapted for electrical engagement with a respective said ground pad of said first circuit.

8. The connector according to claim 3 including an outer shield extending around four sides of said second housing part, two sides of which are parallel to said elongated ground plate and the other two sides of which are perpendicular to said ground plate, said outer shield being electrically conductive and having a plurality of leads adapted to be electrically interconnected to said ground pads of said second circuit.

9. The connector according to claim 8 wherein each said lead of said outer shield is in electrical engagement with a respective one of said leads of said elongated ground plate.

10. The connector according to claim 9 wherein each of said leads of said elongated ground plate is interposed between a respective lead from said outer shield and a respective ground pad of said second circuit.

11. The connector according to claim 9 wherein each of said second contacts is spaced from an adjacent second contact a first distance and said each second contact is spaced from said outer shield a second distance that is less than said first distance.

12. The connector according to claim 3 wherein said first housing part includes locating features adapted to accurately engage mating features on a first template for accurately positioning and holding two first housing parts.

13. The connector according to claim 12 wherein said locating features are pins projecting from said first housing part and said mating features are holes in said first template.

14. The connector according to claim 13 wherein said first template includes mating features for receiving several first housing parts arranged in multiple rows.

15. An electrical connector for interconnecting first and second electrical circuits on first and second circuit boards, respectively, said electrical circuits having both ground pads and signal pads, comprising:

(a) first and second matable housing parts each profiled to house rows of signal contacts, said first housing part having an opening extending along its length between said rows of signal contacts;

(b) a central planar electrically conductive ground plate disposed between said rows of signal contacts in said second housing part and received in said opening in said first housing part, a plurality of leads extending outwardly from said planar ground plate substantially perpendicular to a major surface of said ground plate and adapted for electrical engagement with said second circuit;

(c) an outer shield extending about four peripheral sides of said second housing part and having a plurality of leads extending therefrom, wherein some of said plurality of leads of said ground plate are in electrical engagement with respective ones of said plurality of leads of said outer shield.

16. The connector according to claim 15 wherein said outer shield has two sides which are substantially parallel to said ground plate, said plurality of leads extending from said two sides, and said outer shield being electrically conductive.

17. The connector according to claim 16 wherein each said lead of said outer shield is in electrical engagement with a respective one of said leads of said ground plate.

18. The connector according to claim 17 wherein each of said leads of said ground plate is interposed between a respective lead from said outer shield and a respective ground pad of said second circuit.

19. The connector according to claim 17 wherein each of said second contacts is spaced from an adjacent second contact a first distance and said each second contact is spaced from said outer shield a second distance that is less than said first distance.

20. The connector according to claim 15 wherein said second housing part includes features adapted to accurately engage mating features on a template for accurately positioning and holding two second housing parts during assembly to a circuit board.

21. The connector according to claim 20 wherein said locating features are pins projecting from said second housing part and said mating features are holes in said template.

22. The connector according to claim 21 wherein said template includes mating features for receiving several second housing parts arranged in multiple rows.

23. An electrical connector for interconnecting ground and signal pads between a pair of circuit boards, the connector having first and second matable housing parts each profiled to house rows of signal contacts, the first housing part having first, second, and third openings extending along its length a row of signal contacts in each of the first and third openings, the second opening arranged for receiving an electrically conductive planar elongated ground plate disposed between the rows of signal contacts in the second housing part, the electrical connector comprising:

a plurality of shield plates disposed inside the first housing part, a respective one of the plurality of shield plates being positioned between each pair of adjacent signal contacts, each shield plate being profiled to engage the elongated ground plate and having portions extending into both the first and third openings.

24. The connector according to claim 23 wherein said elongated ground plate has a plurality of leads spaced along its length interconnected to respective ground pads on one of said circuit boards and wherein each said shield plate has a lead adapted for electrical engagement with a respective ground pad of the other of said circuit boards.

25. The connector according to claim 24 wherein said shield plates is a flat stamping having a base and two shield portions extending, in a plane, cantilevered from said base with opposing spaced edges, each of said opposing edges having a contacting surface thereon for effecting the electrical engagement with said elongated ground plate.

26. The connector according to claim 25 wherein said second housing part has a pair of opposed contact receiving walls, each of which has a plurality of spaced inner recesses, each said shield portion extending into a respective one of said inner recesses, and wherein one of said shield portions is between some of said signal contacts in one row and the other of said shield portions is between others of said signal contacts in another row, and wherein said contacting surfaces of each of said shield plates are in said second opening of said first housing part.

27. The connector according to claim 25 wherein two shield portions of each said shield plate are resilient beams spaced apart so that their respective contacting surfaces deflect away from each other as said elongated ground plate is inserted therebetween to effect said engagement.

28. The connector according to claim 24 further comprising an outer shield extending around four sides of said second housing part, two sides of which are parallel to said elongated ground plate and the other two sides of which are perpendicular said elongate ground plate.

29. The connector according to claim 28 wherein each of said leads of said elongated ground plate is interposed between and in electrical contact with a respective lead from said outer shield and a respective ground pad of one of the circuit boards.

30. The connector according to claim 28 wherein each of said signal contacts is spaced from an adjacent signal contact a first distance and said each signal contact is spaced from said outer shield a second distance that is less than said first distance.

31. The connector according to claim 24 wherein each of said first housing part includes locating features adapted to accurately engage mating features on a template for accurately positioning and holding two first housing parts.

32. The connector according to claim 31 wherein said locating features are pins projecting from said first housing part and said mating features are holes in said template.

* * * * *